US005169330A

United States Patent [19]

Adlon et al.

[11] Patent Number: 5,169,330

[45] Date of Patent: Dec. 8, 1992

[54] UNIVERSAL CONTACT SYSTEM AND TEST FIXTURE

[75] Inventors: Daniel T. Adlon; David A. College; David J. Erb, all of Harrisburg, Pa.

[73] Assignee: AMP Incorporated, Harrisburg, Pa.

[21] Appl. No.: 895,155

[22] Filed: Jun. 5, 1992

Related U.S. Application Data

[63] Continuation of Ser. No. 477,794, Feb. 9, 1990, abandoned.

[51] Int. Cl.[5] ..... H01R 23/02

[52] U.S. Cl. ..... 439/218; 439/511

[58] Field of Search ..... 439/181, 218, 219, 221, 439/482, 483, 507, 509, 510, 511, 514, 515; 324/72.5, 158 F, 158 P

[56] References Cited

U.S. PATENT DOCUMENTS

| | | | |
|---|---|---|---|
| 2,205,186 | 6/1940 | Andre | 439/221 |
| 3,760,335 | 9/1973 | Roberts | 339/99 R |
| 4,090,667 | 5/1978 | Crimmins | 439/511 |

FOREIGN PATENT DOCUMENTS

| | | | |
|---|---|---|---|
| 553014 | 2/1958 | Canada | 439/221 |

OTHER PUBLICATIONS

Miller Cordsets publication.

*Primary Examiner*—Gary F. Paumen

[57] ABSTRACT

This invention relates to a contact system (50) which includes spring contacts (54, 56) of a geometry and position to mate with the contacts (26, 38) of differing geometries of plug (12) and receptacle (14) connectors and particularly to the use of such system to test connectors of different geometries.

4 Claims, 4 Drawing Sheets

FIG. 5A
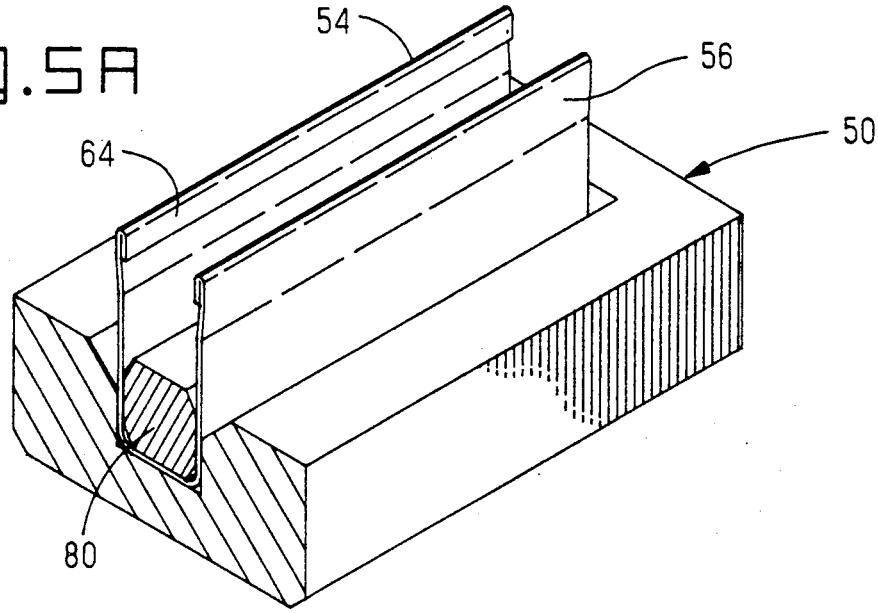
FIG. 5B
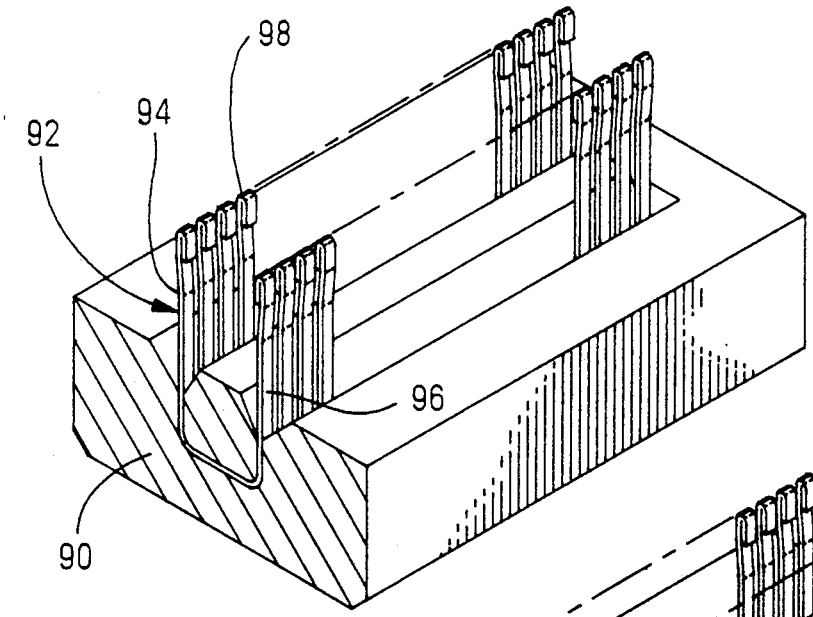
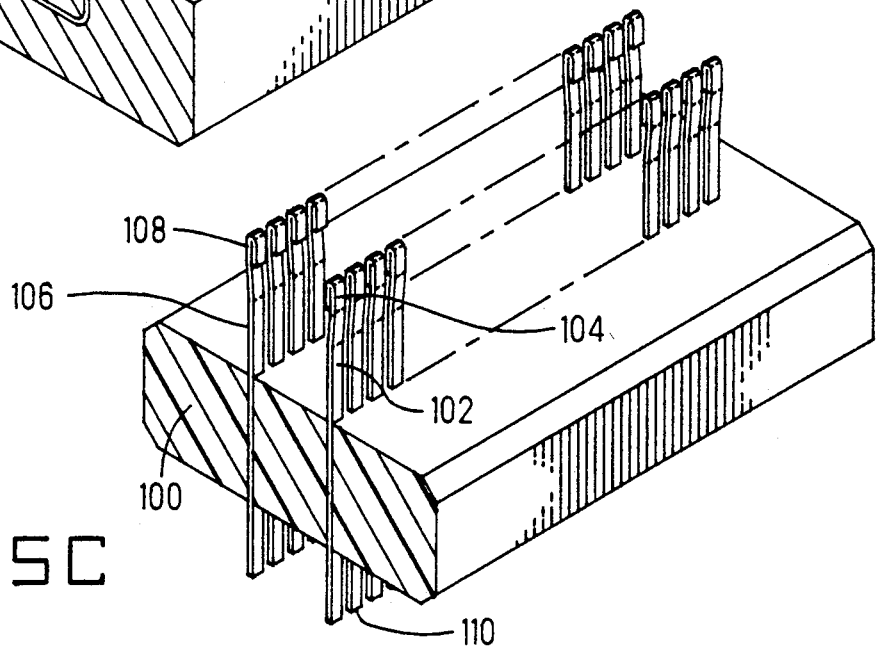
FIG. 5C

UNIVERSAL CONTACT SYSTEM AND TEST FIXTURE

This application is a continuation of application Ser. No. 07/477,794 filed Feb. 9, 1990, now abandoned.

This invention relates to an electrical contact system which includes spring contacts carrying surfaces to engage the contacts of plug and receptacle connectors of different geometries and to a use of such contact system in a test fixture.

BACKGROUND OF THE INVENTION

The type of preloaded electrical connector shown in U.S. Pat. No. 3,760,335 issued Sep. 18, 1973 to L. E. Roberts typifies a form of connector having multiple contacts arrayed in rows in plug and receptacle connector halves and adapted to be terminated to the different wires of a multi-wire electrical cable. Such connectors are widely used in telephone and data interconnection systems and are frequently assembled onto cable wires with automatic or semi-automatic tooling. U.S. Pat. application Ser. No. 329,470 filed Mar. 28, 1989 in the name of Joseph Michael Bowling and Matthew Taylor Miller shows a method of making a cable assembly utilizing connectors of the type shown in the aforementioned issued patent. With respect to such method and the apparatus related thereto, an important step relates to testing the connector to make sure that termination has been in fact made and continuity between terminal and wire is present. Past practice in this regard has involved probing each contact following termination; probing the several contacts following termination of all wires related to the connector through the use of a specially prepared mating connector half plug or receptacle after a cable has been fabricated, or in certain cases and in the case of the aforementioned method, testing the connector for continuity as the cable termination process proceeds using specially prepared plug and receptacle mating connector halves. All of these practices require labor and time, either through the need to probe or through the need to change connector half, plug, or receptacle in accordance with the connector half being tested; this latter requirement interrupting the otherwise automatic machine cycle repeatedly as the plug and receptacle halves of a cable harness are terminated and tested.

The type of multi-contact connectors disclosed in the aforementioned patent and application have a common feature with respect to many other types of connectors in that the housings thereof are arranged in plug and receptacle or male and female forms with the contacts in each of the different halves positioned to mate along a common axis extending in a plane or planes defined by the rows of contacts in both different halves of the connector. The contacts or the connectors are typically surrounded by plastic of the connector housings on one side or the other, depending upon whether the contact is associated with a plug or a receptacle. These constructions make it difficult to probe the contacts, except with an appropriately opposite mating connector half.

Accordingly, it is an object of the present invention to provide a contact system useful in mating with the contacts of plug and receptacle connectors despite the differences in geometry and location of the terminals within such different connector halves. It is a further object to provide a contact system useful with both plug and receptacle halves of a connector to save labor and reduce the cost of changeover during testing or other mating operations wherein both plug and receptacle halves must be interconnected.

It is a final object of the invention to overcome the shortcomings heretofore mentioned in the background of the invention particularly with respect to the provision of a test fixture utilizing the contact system of the invention.

SUMMARY OF THE INVENTION

The present invention utilizes a contact system wherein spring contacts have terminal portions of constant cross-sectional configuration so as to have identical deflection characteristics, which terminal portions carry on the free ends thereof contact areas oriented oppositely to be engaged oppositely by the contacts of plug and receptacle connectors driven axially along the axis of the terminal portion of the contact system. The end of the contact portion of the system is rounded to lead to the oppositely oriented contact portions so that when engaged by the normally sloped or curved leading surface of a plug or receptacle contact, such contact is guided up or down to the appropriate contact area automatically upon intermating closure. This allows the use of a single contact structure for two different types of contacts mounted in two different types of housings. The terminal portion of the contact system is free-standing so as to be clear on either side to leave room for portions of the plastic housing of the mating plug and receptacle which, when applied, ultimately pass over the top of the terminal portion or beneath it. The contact system is made in a number of embodiments of a geometry to engage all of the contacts of a given row of contacts in plug and receptacle halves simultaneously and commonly, or alternatively, individually and engagement with multiple rows is contemplated.

BRIEF DESCRIPTION OF THE DRAWINGS

FIG. 5*a* is a perspective of the contact system of the invention in one embodiment with FIGS. 5*b* and 5*c* representing perspectives of two alternative embodiments of the contact system of the invention.

DESCRIPTION OF THE PREFERRED EMBODIMENT

Figure 1:
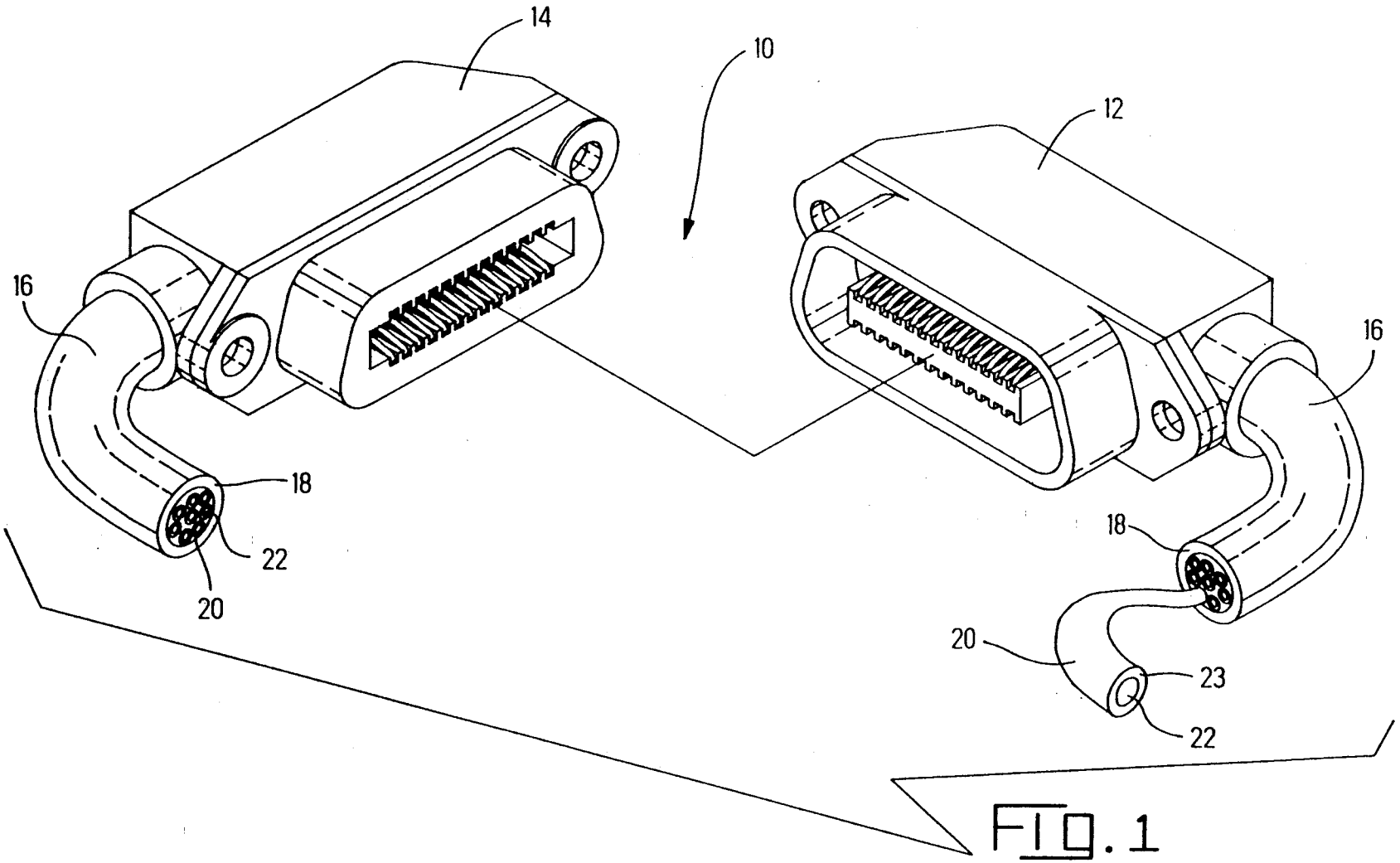
FIG. 1 is schematic view of cable and intermating plug and receptacle connectors of the type under consideration.

There is shown in FIG. 1 a plug and receptacle connector 10 comprised of intermating connector halves including a plug half 12 and a receptacle half 14. Each of these connector halves is terminated to a multi-wire conductor cable 16 which is typically comprised of an outer sheath or jacket 18 inside of which are a plurality of wires 20 each of which contains a conductor 22 surrounded by insulating sheath shown as 23 in the single wire 20 carried forward and somewhat enlarged in FIG. 1. Multi-wire cables such as 16 quite commonly number between fourteen and sixty-four with the associated connector halves having a similar number of individual contacts. The wires are terminated to such contacts in a suitable fashion and reference is hereby made to U.S. Pat. No. 3,760,335, previously mentioned, for a description of one method of such termination, it being understood that the particular type of termination employed is not relevant to this application, it being understood that in one aspect of the invention, the terminals are preloaded in the connector halves and terminated to wires while in place in the connector half.

Figure 2:
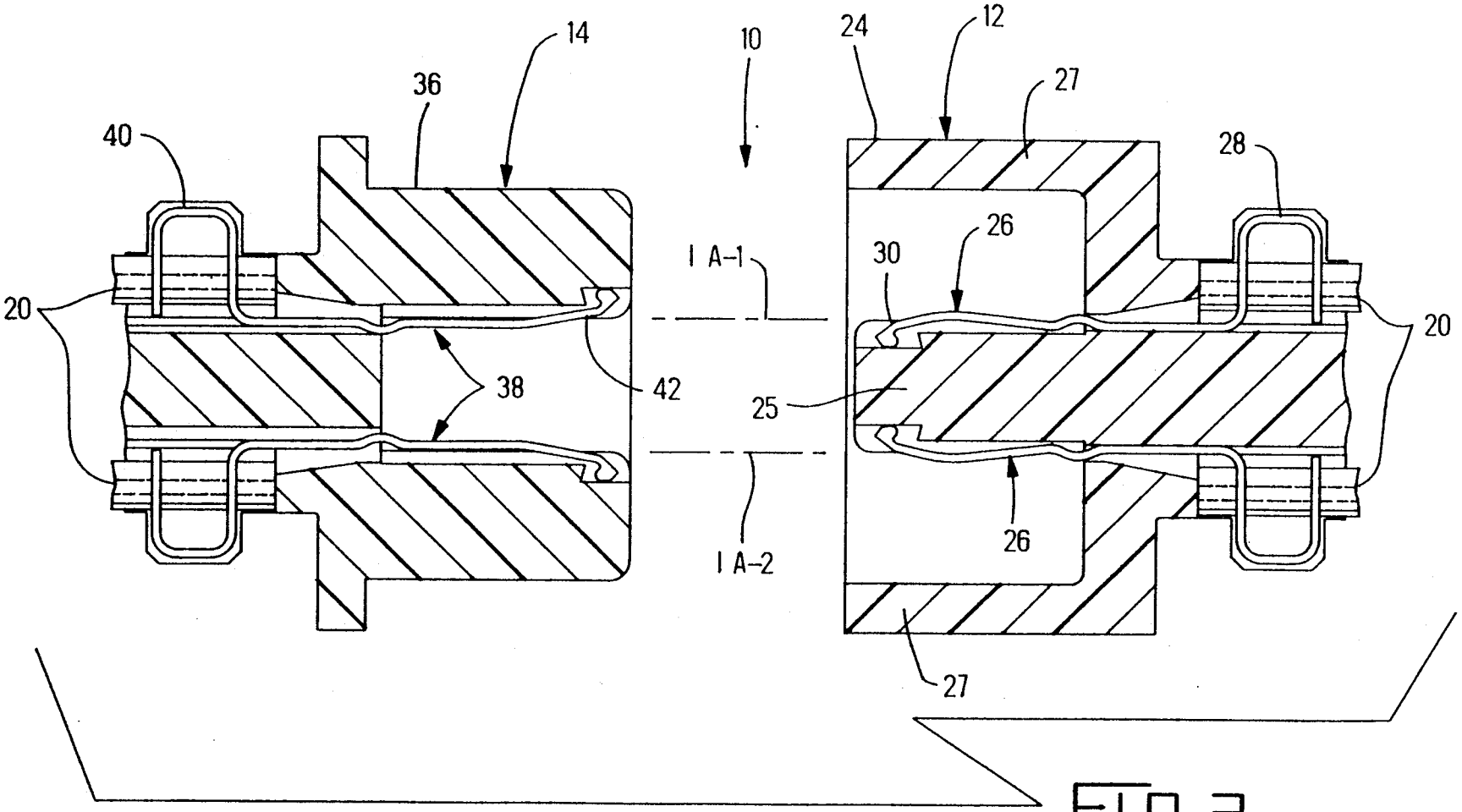
FIG. 2 is sectional view showing the details of plug and connector halves.

In FIG. 2, the wires 20 can be seen positioned in connector halves in terminals therein. Thus, the plug half 12 may be seen to have a housing 24 containing two rows of contacts 26 each having a rear portion 28 terminating a given wire 20 and a forward contact portion 30 which faces oppositely and outwardly with respect to the upper row of contacts and relative to the lower row of contacts which face downwardly in the context of the showing of FIG. 2. As can be discerned from FIG. 2, the housing 24 includes a projection of plastic material 25 extending beneath the rows of contacts 26 and supporting such and additionally and spaced therefrom, outer walls 27 which protect the overall connector structure.

The connector half 14 includes a housing 36 containing two rows of contacts 38 due to be terminated to conductor wires 20 through end portions 40 with the forward end portions of the contact shown as 42 directed inwardly of the housing and in an opposite relative sense between the two rows to define a receptacle which receives the opposite plug portion of the connector half.

Also shown in FIG. 2 through the pair of dotted lines labeled IA-1 and IA-2 are intermating axes of the two rows of contacts for the plug and receptacle. This showing is intended to reveal the nature of the type of intermating which has the various contacts closing and engaging along a common axis; thus, the contacts 26 approach the contacts 38 in the plane and along the axis of such plane IA-1 and the contacts in the lower row opposite 26 and 38 approach each other along the common intermating axis IA-2. Also to be noted is the presence of plastic material just adjacent each contact on one side or the other with respect to the plug and receptacle halves.

Figure 3:
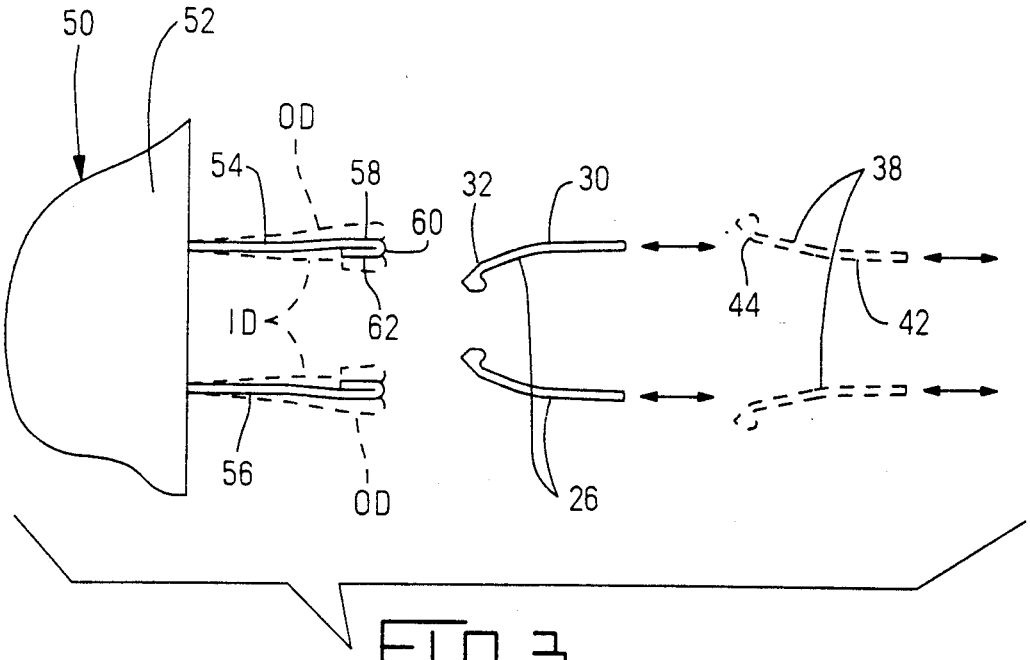
FIG. 3 is a schematic view showing the connector system of the invention in relation to the differently oriented contacts of plug and receptacle connector halves relative to axes of closure during intermating.

Referring now to FIG. 3, the ends of the contacts 26 and 38 are shown in phantom as they would reside upon approach in the planes formed by the intermating axes along each row, upper and lower, of the contacts. The contacts are shown in relation to the axis of closure which can be seen as essentially common with respect to the contacts of plug and receptacle in each of the rows, upper and lower. In FIG. 3 referring to the upper plug contact 26, it will be seen to have a contact area 30 and thereadjoining a sloped or ramped surface 32 which provides a lead-in when mating with the contact portion 42 of the receptacle contact 38. Similarly, the receptacle contact 38 will be seen to have the contact area 42 and thereadjoining a sloped surface 44 which serves as a lead-in or ramp when engaging the opposing contact in a plug half. As can be seen, the contacts of the plug and receptacle face outwardly and inwardly, respectively, or in FIG. 2, upwardly and downwardly with respect to the center line of the connector and with respect to a given plane of intermating axis. The two rows of contacts in a given connector half also face oppositely in an upward or a downward sense as shown in FIG. 3.

Figure 4A:
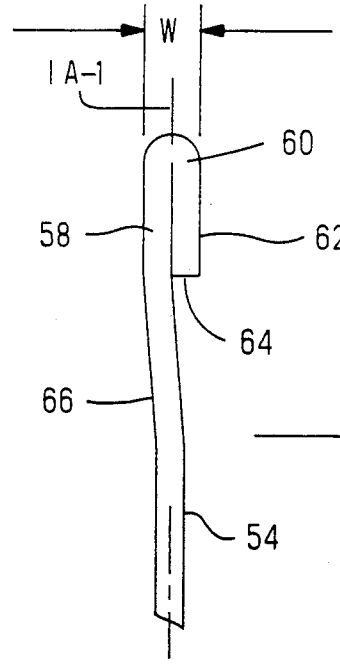
FIG. 4*a* is an elevational view of the end of a contact terminal as shown in FIG. 3, much enlarged.

To the left of FIG. 3 is positioned the connector in accordance with the preferred embodiment of the invention, such connector shown as 50 to include a housing 52 and affixed therein a pair of contacts including contact arms 54 and 56 which each contain at the free ends thereof oppositely oriented contact surfaces 58 and 62 joined by a curved or rounded leading end surface 60. Each of the contact arms 54 and 56 extend outwardly of the connector housing 52 and are free-standing on either side so as to provide clearance for any portions of the plastic housings of the plug and receptacle which must pass therealong due to their configuration as indicated in FIG. 2. Also shown in FIG. 3 through the dotted lines labeled OD and ID are the exaggerated deflection characteristics of the contact arms responsive to engagement with an appropriate contact 26 or 38. Referring now to FIG. 4*a*, the terminal arm portion 54 may be seen to be formed by a folding over of the metal stock of which it is made with an end 64 and a deformation 66 made to position the surfaces 58 and 60 equidistant from the center line of arm 54 or the insertion axis IA-1 with respect to the upper contact arm 54. To be noted in FIG. 4*a*, the contact areas 58 and 62 are spaced apart by a distance W which, in accordance with the invention in one embodiment is to be minimized, so as to minimize the deflection of the arm 54 and the forces related thereto caused by engagement on one side or the other by plug and receptacle contacts. The stock from which the contact, including arm 54 and the remaining structure is made, is preferably quite thin; in an actual unit being on the order of 0.010 inches in thickness when formed of half hard high conductivity phosphor bronze. The width W in such case would accordingly be on the order of 0.020 inches in thickness. The purpose of the folding is to provide the rounded surface 60 rather than a sharp edge which might gouge and injure the surfaces of the plug and receptacle contacts.

Referring back to FIG. 3, it is apparent that as a given contact 26 or 38 is driven to approach connector 50, the sloped end surfaces 32 and 44, respectively, will engage a portion of the rounded surface 60 and be driven upwardly or downwardly accordingly with the contact areas 30 and 42 following to rest on the flat areas of the end of the arms 54. Thus, the contact area 30 will be guided downwardly to rest on the contact area of surface 62 of the contact 26 deflecting as it would deflect in use with a mating connector half. And also the contact area 42 would be guided by the engagement of the sloped surface 44 with 60 upwardly or outwardly so that the contact area 42 resides on the contact area of surface 58. The same sort of action would result with the lower row of contacts of each plug and receptacle. In accordance with the invention concept in one embodiment, the arms 54 are made relatively stiff so that most deflection in the system takes place in the contacts of the plug and receptacle and very little deflection takes place in the contact arm of the contact system of the invention. In accordance with another embodiment 70 to be hereinafter described, more deflection may be permitted than with the contact arm 54.

It should thus now be apparent how a single contact operates to accommodate mating contacts of different configurations and geometries driven along a common axis of engagement.

Figure 4B:
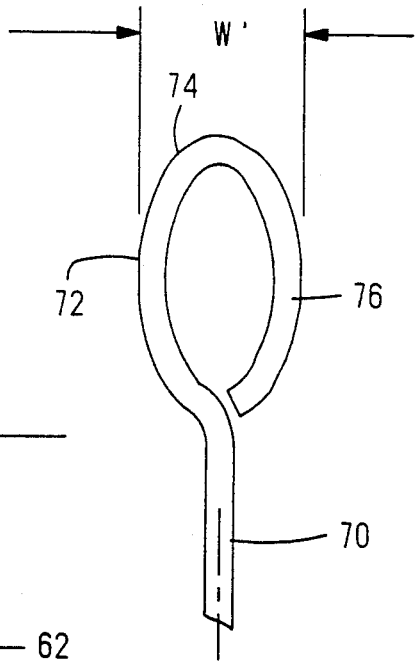
FIGS. 4*b* and 4*c* are similar views of alternative embodiments of the end of a terminal.

FIG. 4*b* shows the contact arm, the end thereof 70 which is formed to define a pair of contact surfaces 72 and 76 joined by a rounded or curved surface 74 having a width W' considerably greater than W heretofore referred to. This configuration would be used with mating contacts wherein a greater deflection is sought for increased normal forces and lower contact resistance.

Figure 4C:
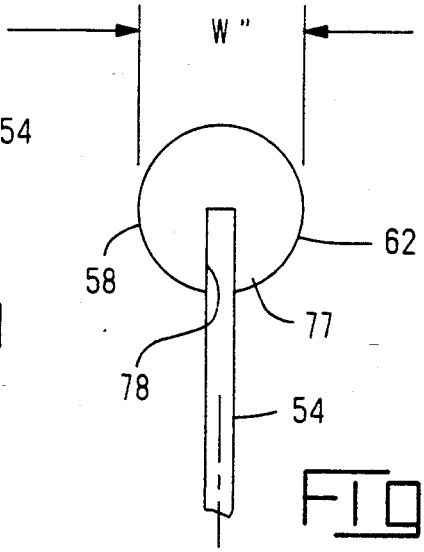

FIG. 4*c* shows a variation in the embodiment shown in FIGS. 4*a* and 4*b* wherein a solid, cylindrical-shaped conductive member 77, such as brass for example, having a longitudinal slot 78 is attached to the edge of the contact arm 54. The slot 78 may be sized to be a press fit with the arm 54, or the two parts may be brazed or welded together, or any other suitable joining means may be utilized as long as electrical continuity exists between the conductive member 77 and the arm 54. In the present example, the diameter W" of the member 77 is 0.044 inch, however, any suitable diameter may be used.

FIG. 5*a* shows an embodiment of the contact system of the invention wherein the arms heretofore described as 54 and 56 are seen to be continuous and formed by a single sheet of material in a general U or trough shape. Interiorly of the bite of the U is located an insert shown as 80 and the housing 50 is made to clamp against the upstanding walls of the U to hold such rigid against the insert 80. In an actual embodiment, the various elements of a housing 50 and the insert 80 were formed of machined plates of steel and/or aluminum, respectively, and suitably clamped together as by machine screws. An advantage of the structure shown in FIG. 5*a*, in addition to its simplicity and ease of manufacture, is that the various contact areas 58 and 62 are not tied to particular centers and thus the device can be utilized with connectors having contacts on different centers.

It is contemplated that the structure 5*a* may be modified so that the upstanding portions of the U-shaped structure shown are separated and can be stacked and clamped with inserts 80 of different widths to adjust the structure to accommodate connectors having rows of contacts on different side spacings.

FIG. 5*b* shows a contact system, including a housing 90, carrying a series of U-shaped contact arms 92, each having upstanding portions 94 ending as contacts 98 which could be formed in the same manner heretofore referred to with respect to arm 54. A plurality of these U-shaped elements, one for each contact in a given row of contacts in a connector having oppositely opposed surfaces as heretofore mentioned, may be heretofore employed. The individual U-shaped contacts 92 may be held in a common metallic material of which 90 is made or alternatively, in a plastic material so that the several contacts are electrically isolated one from the other for a variety of purposes and uses.

FIG. 5*c* shows a further alternative embodiment of the invention wherein a plastic housing 100 is made to contain a plurality of contact arms 102 each ended as at 104. Opposite to the contacts 102 is a row of contacts such as 106 ended as at 108. Both ends of the contacts can be considered as described relative to the contacts in FIG. 4*a*. The individualized contacts may be commoned through the use of printed circuit techniques in a printed circuit attached to the ends 110 or may be selectively connected thereby to circuit traces for a variety of reasons.

When used for testing purposes, the contact system of the present invention in a configuration as shown in FIGS. 5*a*–5*c* may be affixed in tooling which operates to terminate the wires of the multi-wire cable to the various connector halves with the appropriate connector half, plug, or receptacle plugged in to engage the contact system of the invention. In the embodiment shown in FIG. 5*a*, or in the other embodiments wherein all the contacts are commoned electrically and grounded, continuity may be checked for each wire installed in a given connector half in the manner described in the patent application Ser. No. 329,470, heretofore mentioned. Alternatively and with respect to the embodiment shown in FIGS. 5*b* and 5*c*, the termination of a wire to a given contact in a given plug or receptacle half may be sensed through circuits connected to the several contacts which are individually connected to either other contacts of the connector halves or to other circuitry isolated electrically in the manner heretofore discussed.

It is contemplated that the contact system of the invention may be utilized for a variety of purposes in regards to interconnecting to plug and receptacle halves for other than test purposes and the contact system of the invention should be construed through the definition set out in the attached claims.

What is claimed is:

1. In combination, a pair of plug and receptacle connector halves and a test fixture for alternatively testing the plug or receptacle connector halves which are of a type having intermating housings and rows of spring contacts connected to the wires of an electrical cable at one end and held projecting forwardly from said one end toward an opposite end along an axis of intermating of the halves, the rows of contacts of each half being held by said housing spaced apart a given distance to be deflected at right angles to said axis by being intermated with the contacts of the opposite half, the contacts of the plug half facing outwardly and the contacts of the receptacle half facing inwardly relative to said axis, the test fixture including a housing holding spring contacts spaced apart by a given distance to include a first contact surface oriented inwardly to engage the contacts of the plug half and a second contact surface facing outwardly to engage the contacts of the receptacle half with the engagement deflecting the test fixture contacts and the contacts of the plug or receptacle half to provide an electrical interconnection therebetween for electrical test purposes.

2. The combination of claim 1 wherein the said spring contacts of the test fixture are comprised of a single piece of conductive flat sheet stock folded into a U cross sectional shape to position the first and second contact surfaces to engage the contacts of the plug or receptacle connector halves.

3. The combination of claim 1 wherein said spring contacts of the test fixture are comprised of a plurality of individual contacts of a U-shaped cross sectional configuration and the housing of the test fixture is made of an insulating material to hold the individual contacts positioned to engage the contacts of the plug or receptacle connector halves to test for continuity of pairs of the plug or receptacle contacts.

4. The combination of claim 1 wherein the contact springs of the test fixture include a plurality of individual contacts and the test fixture housing is insulative and holds said individual in position to engage the contacts of the plug or receptacle halves to test for continuity of individual contacts of the plug and receptacle contacts.

* * * * *